US010465316B2

(12) United States Patent
Bagwell et al.

(10) Patent No.: US 10,465,316 B2
(45) Date of Patent: Nov. 5, 2019

(54) OUTDOOR FABRIC

(71) Applicant: Glen Raven, Inc., Glen Raven, NC (US)

(72) Inventors: Ricky Benjamin Bagwell, Duluth, GA (US); Samuel J. Lynn, Easley, SC (US)

(73) Assignee: Glen Raven, Inc., Glen Raven, NC (US)

( * ) Notice: Subject to any disclaimer, the term of this patent is extended or adjusted under 35 U.S.C. 154(b) by 954 days.

(21) Appl. No.: 14/831,432

(22) Filed: Aug. 20, 2015

(65) Prior Publication Data

US 2017/0051440 A1 Feb. 23, 2017

(51) Int. Cl.
*D04B 21/16* (2006.01)

(52) U.S. Cl.
CPC ..... *D04B 21/16* (2013.01); *D10B 2401/063* (2013.01); *D10B 2401/22* (2013.01)

(58) Field of Classification Search
None
See application file for complete search history.

(56) References Cited

U.S. PATENT DOCUMENTS

| | | | | |
|---|---|---|---|---|
| 4,334,401 | A | 6/1982 | Bahia | |
| 4,996,100 | A | 2/1991 | Druckman | |
| 5,807,794 | A * | 9/1998 | Knox | D03D 15/00 442/306 |
| 6,557,590 | B2 | 5/2003 | Swers et al. | |
| 6,615,618 | B2 | 9/2003 | Kost | |
| 7,537,238 | B2 | 5/2009 | Kanuma | |
| 8,695,151 | B2 | 4/2014 | Dilyard et al. | |
| 2004/0261953 | A1 | 12/2004 | Hart | |
| 2005/0009430 | A1 | 1/2005 | Tsung-Yueh | |
| 2008/0313980 | A1 | 12/2008 | Holland et al. | |
| 2012/0064263 | A1 | 3/2012 | Ayers et al. | |

FOREIGN PATENT DOCUMENTS

| | | |
|---|---|---|
| AU | 2013100956 | 8/2013 |
| AU | 2015100021 | 2/2015 |
| CN | 201817638 | 5/2011 |
| CN | 203187856 | 9/2013 |
| CN | 104652008 | 5/2015 |
| EP | 0733732 | 9/1996 |
| WO | 2005007956 | 1/2005 |
| WO | 2004011961 | 1/2007 |

(Continued)

OTHER PUBLICATIONS

Machine translation of EP0733732; Dinger et al. (Year: 1996).*

(Continued)

*Primary Examiner* — Shawn Mckinnon
(74) *Attorney, Agent, or Firm* — Womble Bond Dickinson (US) LLP

(57) ABSTRACT

A knit shade cloth. The shade cloth includes about 10% to about 40% by weight of un-textured yarns comprising at least one of olefin or polyester for strength. The shade cloth includes about 60% to about 90% by weight of at least one synthetic textured yarn for improved hand. The knit shade cloth provides at least about 150 lbs. of initial mean break strength in both a warp direction and weft direction to provide sufficient performance as a shade sail.

14 Claims, 3 Drawing Sheets

(56) References Cited

FOREIGN PATENT DOCUMENTS

| | | |
|---|---|---|
| WO | 2008057205 | 5/2008 |
| WO | 2011026946 | 3/2011 |

OTHER PUBLICATIONS

Chattopadhyay (Technical Textile Yarns, R. Chattopadhyay, Woodhead Publishing, 2010, pp. 3-55). (Year: 2010).*

Sunbrella Shade Sail, Shade Sails with Marine Grade Sunbrella, Glen Raven, http://www.backyardcity.com/Shade-Sails-Sunbrella.htm, dated Jan. 28, 2015, last viewed Jan. 28, 2015, 6 pgs.

Comshade, Extra Heavy Duty Knitted Shadecloth, Polyfab, http://www.polyfab.com.au/pdfs/comshade_brochure.pdf, last viewed Feb. 12, 2015, 2 pgs.

Monotec 370 Series, Pro-Knit Industries Pty Ltd., http://www.shadesails.com/information/custom-fabrics, dated Jan. 28, 2015, last viewed Jan. 28, 2015, 3 pgs.

Z16, Rainbow Shade, http://www.globalshade.com.au/wp-content/uploads/2011/04/Z16-Technical-Specs.pdf, last viewed Feb. 12, 2015, 1 pg.

ExtraBlock, A Shadecloth that Provides Protection as well as Aesthetics, Halifax Vogel, http://www.globalshade.com.au/wp-content/uploads/2011/04/Extrablock-Complete-Flyer.pdf, last viewed Feb. 12, 2015, 4 pgs.

Driz All Weather Shade Protection, Rainbow Shade, http://www.rainbowshade.com.au/wp-content/uploads/2014/10/DRiZ-Brochure.pdf, last viewed Feb. 12, 2015, 3 pgs.

Coolhaven Shade Sail, Gail Pacific, http://www.coolaroousa.com/en/shade-sails/coolhaven-shade-sails-1/coolhaven-shade-sail-473792_group, dated Jan. 28, 2015, last viewed Jan. 28, 2015, 2 pgs.

Kool Kolors Shade Sail, Gale Pacific, http://www.coolaroousa.com/en/shade-sails/kool-kolor-shade-sails/kool-kolors-shade-sail-434489_group, dated Jan. 28, 2015, last viewed Jan. 28, 2015, 2 pgs.

Australian Examination Report No. 1 for App. No. 2016213765, dated Dec. 7, 2016, 6 pgs.

European Search Report for App. No. 16184638.1, dated Jan. 19, 2017, 7 pgs.

* cited by examiner

OUTDOOR FABRIC

FIELD OF INVENTION

The present disclosure relates to knit fabrics suitable for outdoor use. Particularly, this disclosure relates to fabrics configured for providing shade, such as fabric used in shade sails.

BACKGROUND

Architects and landscapers understand the importance of providing areas of shade to shield occupants from the sun's rays. Shade structures enhance the ability to use outdoor spaces during the heat of the day. FIG. 1 shows an example of a shade sail 10. Shade sails 10 are created by tensioning a membrane 12, often a fabric, between several spaced apart support posts 14 or mounting points. Shade sails 10 are often used because of the elegant appearance created by the membrane 12 as it is stretched to form a non-planar three-dimensional shape between the support posts 14. The membrane 12 itself can be provided in a variety of shapes and patterns stretched between three, four, or even more support posts 14.

The membranes 12 of current shade sails 10 must be constructed with sufficient strength to accept the tensioning forces applied at each support post 14 while extending over unsupported spans of several feet, often ten feet or more. By the nature of their use outdoors, the presently used membranes 12 are intended to avoid premature degradation in both strength and appearance often caused by exposure to light from the sun.

A representative membrane 12 currently available for shade sails 10 are fabrics such as Synthesis AF230™ sold under the Coolaroo® Brand by Gale Pacific. This fabric is a 3-bar warp knit fabric formed entirely of UV stabilized high density polyethylene (HDPE). While the knit HDPE fabrics meet many of the structural characteristics for suitability as a shade sail, HDPE yarns provide a synthetic plastic appearance. Therefore, there remains a need for alternative fabrics suitable for providing shade in outdoor environments.

SUMMARY

One embodiment includes a knit shade cloth. The shade cloth may have about 10% to about 40% by weight of un-textured yarns comprising at least one of olefin or polyester, and about 60% to about 90% by weight of at least one synthetic textured yarn. The knit shade cloth provides at least about 150 lbs. of initial mean break strength in both a warp direction and weft direction.

Another embodiment includes a fabric comprising a majority, by weight, of at least one textured yarn, and a minority, by weight, of at least one un-textured high tenacity olefin yarn having tenacity of at least 4 grams per denier. The fabric provides at least about 150 lbs. of initial mean break strength in both a warp direction and a weft direction.

Another embodiment includes a fabric comprising, a majority, by weight, of at least one textured yarn, and a minority, by weight, of at least one un-textured high tenacity olefin yarn having tenacity of at least 4 grams per denier such that the fabric is UV stable, capable of forming three-dimensional shapes without creasing, and can extend across an unsupported span of at least about 50 feet to be suitable for use as a shade sail.

These and other aspects of the present invention will become apparent to those skilled in the art after a reading of the following description of the preferred embodiments, when considered in conjunction with the drawings. It should be understood that both the foregoing general description and the following detailed description are explanatory only and are not restrictive of the invention as claimed.

DETAILED DESCRIPTION

Exemplary embodiments of this disclosure are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. Features from one embodiment or aspect may be combined with features from any other embodiment or aspect in any appropriate combination. For example, any individual or collective features of method aspects or embodiments may be applied to apparatus, product or component aspects or embodiments and vice versa.

The present disclosure describes a fabric configured to provide a textile look and feel that improves upon the plastic-like appearance and poor hand of prior art shade sail fabrics that rely exclusively upon HDPE yarns. Fabrics of the present disclosure are high-performance fabrics that, while providing a soft hand and textured appearance, are designed to meet minimum performance characteristics that allow the fabrics to be suitable for use in shade sails at a total weight of between about 8 and about 14 oz./sq. yard.

As used herein, a fabric is suitable for use as a shade sail if the fabric, also referred to as shade cloth, meets at least one, preferably two, more preferably three and most preferably all four of the following performance metrics:

1) The fabric has the strength to be used across unsupported spans of at least about 15 feet, preferably at least about 20 feet, and more preferably as least about 50 feet. Applicants have determined that the fabric should have a mean initial break strength of at least about 150 lbs. in two dimensions, e.g. the warp direction and the weft direction of the fabric, to be spanned across the prescribed distances. Preferably, the fabric will have a mean initial break strength of at least about 180 lbs. in two dimensions to be reasonably spanned across 50 feet or more.

Figure 1:
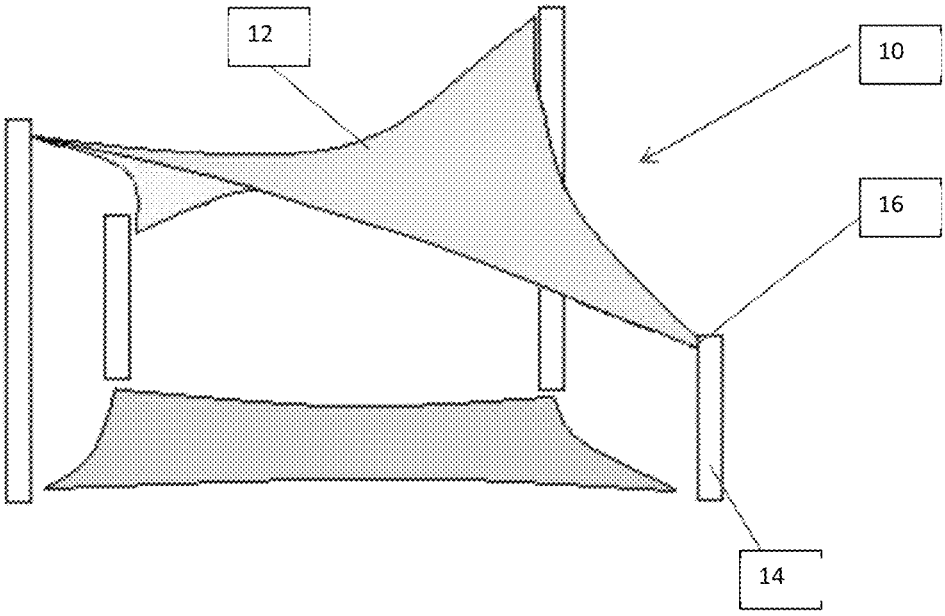
FIG. 1 shows an example of a shade sail.
Figure 2:
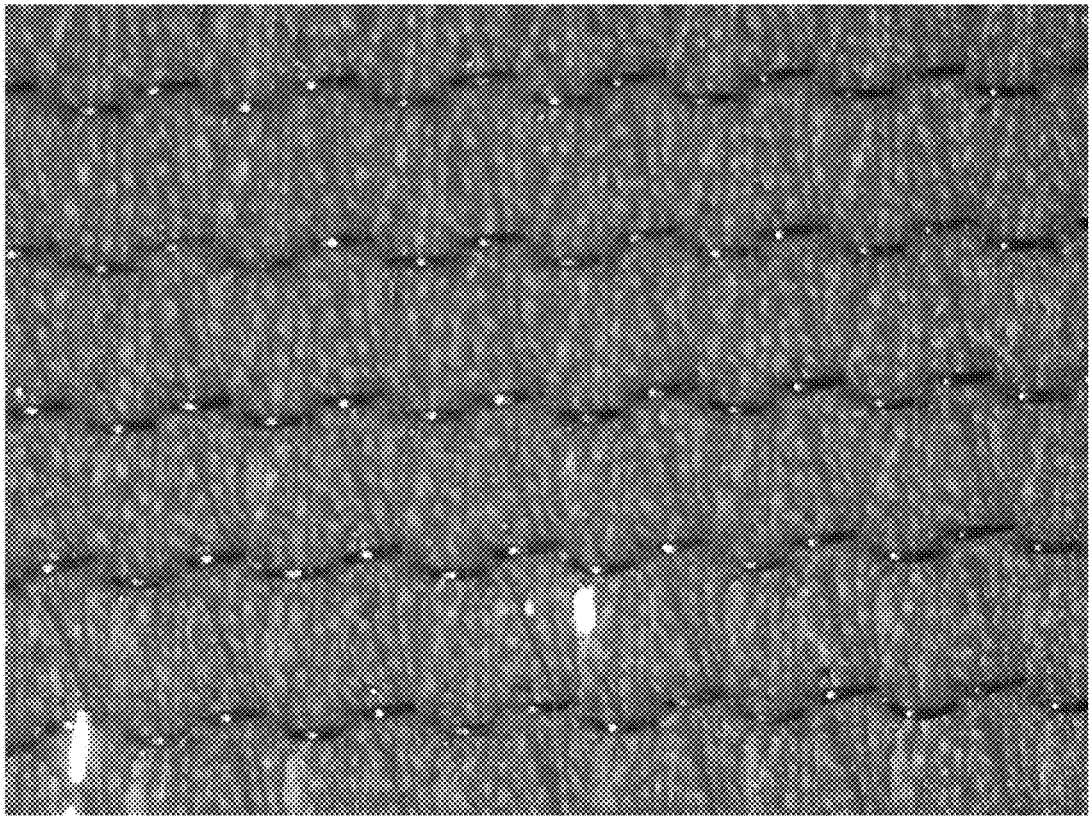
FIG. 2 shows the face of a fabric according to an embodiment of the present disclosure.
Figure 3:
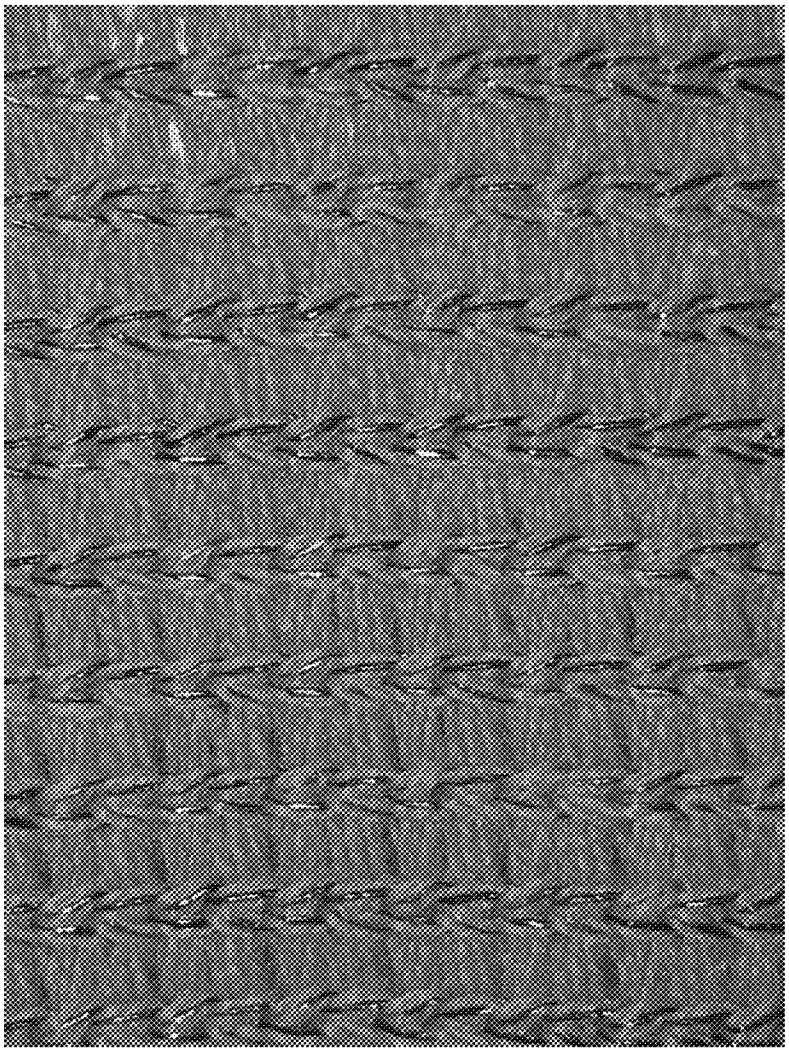
FIG. 3 shows the back of a fabric according to an embodiment of the present disclosure.

2) The fabric should have the ability to elongate and recover to achieve a non-planar three-dimensional shape without premature sagging or creasing when applied across the span distances of the first metric. As seen in FIG. 1, the support posts 14 often have varied heights. The attachment points 16 on the respective support posts 14 often to not lie in a single plane with one another. As a result, the fabric should be able to bend and flex to provide the desired curved, three-dimensional shape without creasing. Knit fabrics provide elongation characteristics that have been found suitable for forming the desired three-dimensional shapes.

On the other hand, fabrics that are woven are believed to crease or sag when shaped over the significant span distances contemplated. Therefore woven fabrics are not believed to be as suitable for use as shade sails. In some embodiments, elongation in each direction should be at least about 30% and less than about 90%. In preferred embodiments, elongation in each direction should be at least about 40% and less than about 60%.

3) The fabric should be UV stable. UV stability provides the fabrics of the present disclosure with the ability to be used outdoors in direct sunlight for an extended period of time, UV stability nay be quantified in terms of color fastness as well as the ability to maintain strength after extended UV exposure. As defined herein, a fabric is UV stable if the fabric subject to UV exposure according to SAE 2527J (version February 2004) subsequently tested under the corresponding Grey Scale (for example available from James Heal in Halifax, England) results in a grade 4 or 5 after total expose of at least 1500 KJs. Alternatively, a fabric is LTV stable if the fabric, subject to UV exposure according to AATCC 169 (version 2003), test cycle option 3, subsequently tested under the corresponding Grey Scale (for example available from James Heal in Halifax, England) results in at least a grade 4 after a total exposure of at least 2200 KJs. As is known in the art, Grey Scale is a well-recognized visual test of colorfastness providing grades from 1 to 5, where grade 5 represents minimal or no change and grade 1 represents sever change in color.

4) Another advantageous characteristic of some embodiments of the fabrics disclosed herein, is the ability for the fabric to be cleaned with chemicals such as chlorine bleach as a result of the materials for the yarns and additives provided thereto.

While the fabrics of the present invention are suitable for use in shade sails, the use of the disclosed fabrics is not limited to shade sails. The fabrics may be referred to as shade cloths generally, applicable to shade sails, awnings, umbrellas, and similar devices used to provide shade from the sun in an outdoor environment. The fabrics of the present disclosure are not necessarily limited to being used for providing shade, but may be used for other purposes where strength and UV stability are desired, such as outdoor patio furniture, or in the marine industry as boat covers or for boat cushions. Use of the fabrics of the present disclosure in indoor settings is also envisioned, such as indoor upholstery that may avoid fading if positioned near a window.

Compared to the prior art, the fabrics disclosed herein provide a softer hand and a more pleasing appearance consistent with the soft hand of the fabrics. Providing the desired hand and appearance may be enhanced by the use of textured yarns. As used herein the term "textured yarns" include air textured yarns, spun yarns, bulk continuous filament yarns, and false twist textured yarns. Spun yarns have been found to be particularly suitable for providing the desired look and feel. The textured yarns can be made from a variety of materials, including acrylic, polyester, polyproylene, polyethylene, and polylactic acid (PLA). For its combination of softness, UV stability, and color fastness, solution dyed spun acrylic yarns have been found to be preferred yarns for the textured yarn portion of fabrics according to embodiments of the present disclosure.

To provide the desired improvements to look and feel of shade cloth fabrics, the textured yarns should form a significant portion of the fabric in terms of total weight. The fabric may have at least 40% textured yarn, may preferably form a majority of the fabric may more preferably comprise about 60% to about 90% of the fabric, and may most preferably form about 80% of the fabric.

Use of a knit fabric formed exclusively of UV stable textured fibers and/or yarns may not have sufficient mean break strength to be suitable for use as a shade sail of the preferred dimensions. Therefore, fabrics of the present disclosure include at least some amount of un-textured yarns. Un-textured yarns may also be referred to herein as non-textured yarns. Un-textured yarns may include flat yarns, partially oriented yarns and generally other yarns that would not fall under the category of textured described above. In some cases the un-textured yarns may be olefins or polyesters. In some embodiments, the un-textured yarns are high tenacity yarns, i.e. having a tenacity of at least 4 grams per denier, to increase the strength of the fabric. Based on factors such as strength, weight, cost, availability, and ability to knit, high tenacity olefins, such as polypropylene and polyethylene, may be preferred. In some cases, monofilament high density polyethylene (HDPE) may be most preferred.

The un-textured yarns may comprise a minority, by weight, of the fabrics of the present disclosure. Some fabrics may include about 10% to about 40% by weight of un-textured yarn. More preferably, un-textured yarn may comprise about 10% to about 25% by weight of the fabric, and most preferably, the fabric may comprise about 20% un-textured yarn, such as high tenacity olefin yarn.

The weight percentage of the un-textured yarn is impacted by the denier of the selected yarn. Preferably the un-textured yarn is a monofilament having a denier between about 100 and about 1000 to provide the desired break strength at the prescribed weight percentages. Multifilament yarns may also be used. The higher denier monofilament yarns are also thicker. The thicker yarns can be more pronounced in their appearance when knit into the fabrics of the present disclosure. On the other hand, the lighter denier yarns provide a reduction in strength. For example, monofilament high tenacity olefin yarns having a denier between about 300 and about 600 may be preferred, for example a 430 denier monofilament HDPE yarn. In some embodiments, two or more ends of the un-textured yarn (monofilament or multifilament) may be included per course, resulting in a doubling or more of the effect denier by multiplying the denier per end by the number of ends. Therefore the effective denier may be between about 200 and about 2000, and preferably between about 600 and about 1200, such as about 860.

In some embodiments, the fabric consists essentially of textured yarns and un-textured yarns. In some embodiments, the fabric consists of textured yarns and un-textured yarns. In an embodiment, the fabric consists or consists essentially of solution dyed spun acrylic yarns and monofilament HDPE yarns. It should be understood that the fabrics of the present disclosure may have additional finishing and materials when used as a shade sail. For example, the edges of the fabric may be cut to the desired size and shape. The edges may be bound, and other hardware or tensioning features may be added to prepare the raw fabric for being installed on support posts 14 as a shade sail membrane 10.

EXAMPLE

A four-bar Raschel warp knitting machine was used to create a sample fabric of having about 12 courses per inch and repeating at 6 wales per inch according to the present disclosure. The machine was set up to feed yarn on each bar according to:

First Bar (Front bar): 430 denier monofilament high density polyethylene (HDPE).

Second Bar (Middle bar): 18/2 spun acrylic.

Third Bar (Middle bar): 18/2 spun acrylic.

Fourth Bar (Back bar): 430 denier monofilament high density polyethylene (knit in an in-lay pattern).

As known in the art, 430 denier monofilament HDPE constitutes a single continuous filament of extruded HDPE with a diameter selected to produce a 430 denier. As known in the art, 18/2 refers to a 2-ply yarn having 18 cotton count formed by spinning staple acrylic fiber.

TEST RESULTS

The fabric produced by the Example was tested for several characteristics. The results are shown below:

| Weight % HDPE | Weight % Acrylic | Break Strength Warp (lbs.) | Break Strength Weft (lbs.) | Elongation Warp | Elongation Weft | Weight (oz. per sq. yd.) |
|---|---|---|---|---|---|---|
| 19.5 | 80.5 | 183 | 283 | 50% | 52% | 11.64 |

The break strength represents an initial mean break strength. The break strength was determined by performing the grab test as described in ASTM D5034 (version 2009). The elongation was similarly determined according to ASTM D5034 (version 2009) after performing the grab test.

The UV stability of the example sample was also tested according to AATCC 169 Option 3 and SAE 2527J as discussed above. After completing the exposure to 2200 KJs and 1500 KJs respectively, the exposed samples were tested using a visual grey scale corresponding to each exposure standard. Suitable grey scales are available from James Heal of Halifax, England. The sample tested to between a grade 4 and a grade 5 after exposure according to SAE 2527J and tested to a grade 4 after exposure according to AATCC 169 as discussed above.

As used herein, the term "about," when referring to a defined, or relative quantity such as denier, weight percentage, coverage, and the like, is meant to encompass variations of ±1%, preferably ±5%, more preferably ±10%, from the specified value or range boundary. For example, where the fabric seeks about 10% of high tenacity fibers as a low end of a range, the term "about" may preferably alter the "10%" value by up to 10% of that value, i.e. producing a lower boundary of 9%.

Although the above disclosure has been presented in the context of exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

We claim:

1. A knit shade cloth, comprising:

a first end comprising about 10% to about 40% by weight of un-textured yarns, the un-textured yarns including high density polyethylene (HDPE) yarns; and a second end comprising about 60% to about 90% by weight of at least one synthetic textured yarn, the at least one synthetic textured yarn includes solution dyed spun acrylic yarn, wherein the knit shade cloth provides at least about 150 lbs. of initial mean break strength in both a warp direction and weft direction.

2. The knit shade cloth according to claim 1, wherein the un-textured yarns have a denier between about 300 and about 600.

3. The knit shade cloth according to claim 1, wherein the cloth comprises n ends of the un-textured yarns per inch and the effective denier determined by denier per end time n is between about 600 and about 1200.

4. The knit shade cloth according to claim 1, comprising:

about 20% by weight of the un-textured yarns; and about 80% by weight of the at least one textured yarns.

5. The knit shade cloth according to claim 1, consisting of:

about 20% by weight of the un-textured yarns; and about 80% by weight of the at least one textured yarns.

6. The knit shade cloth according to claim 5, wherein the un-textured yarns consist of monofilament HDPE yarns, and the at least one textured yarns consist of solution dyed spun acrylic.

7. The knit shade cloth according to claim 1, wherein the shade cloth has a total weight of between about 8 and about 14 oz./sq. yard.

8. The knit shade cloth according to claim 1, wherein the un-textured yarns are high tenacity yarns having a tenacity of at least about 4 grams per denier.

9. The knit shade cloth according to claim 1, wherein the cloth maintains at least a grade 4 on a grey scale after exposure of 2200 KJs according to AATCC 169 Option 3.

10. A fabric comprising:

a majority, by weight, of a textured solution dyed spun acrylic yarn; and a minority, by weight, of an un-textured high density polyethylene (HDPE) yarn having a tenacity of at least 4 grams per denier, wherein the fabric provides at Least about 150 lbs. of initial mean break strength in both a warp direction and a well direction.

11. The fabric according to claim 10, comprising:

about 20% by weight of the HDPE; and about 80% by weight of the textured solution dyed spun acrylic yarn.

12. A fabric comprising:

a majority, by weight, of at least one textured, solution dyed spun acrylic yarn; and a minority, by weight, of at least one monofilament un-textured high density polyethylene (HDPE) yarn having tenacity of at least 4 grams per denier, wherein the fabric is UV stable, capable of forming three-dimensional shapes without creasing, and can extend across an unsupported span of at least about 50 feet to be suitable for use as a shade sail.

13. The fabric according to claim 12, comprising:

about 80% spun acrylic yarns and about 20% monofilament, about 430 denier, HDPE yarns, by weight.

14. The knit shade cloth according to claim 1, wherein the un-textured yarns are multifilament yarns.

* * * * *